US005360364A

United States Patent [19]

Poulsen et al.

[11] Patent Number: 5,360,364

[45] Date of Patent: Nov. 1, 1994

[54] CARDAN JOINT FOR A TOY BUILDING SET

[75] Inventors: Ole V. Poulsen; Jan Hatting, both of Vejle, Denmark

[73] Assignee: Interlego A.G., Baar, Switzerland

[21] Appl. No.: 70,403

[22] PCT Filed: Dec. 3, 1991

[86] PCT No.: PCT/DK91/00374

§ 371 Date: Jun. 4, 1993

§ 102(e) Date: Jun. 4, 1993

[87] PCT Pub. No.: WO92/10261

PCT Pub. Date: Jun. 25, 1992

[30] Foreign Application Priority Data

Dec. 4, 1990 [DK] Denmark ..... 2876/90

[51] Int. Cl.[5] ..... A63H 33/12; A63H 33/08; F16C 11/00; F16D 3/16

[52] U.S. Cl. ..... 446/102; 446/128; 446/36; 403/57; 464/151

[58] Field of Search ..... 464/151, 152, 112, 106; 403/57, 74, 114; 446/102, 103, 87, 88, 128, 36, 383, 487

[56] References Cited

U.S. PATENT DOCUMENTS

| | | | |
|---|---|---|---|
| 1,310,239 | 7/1919 | Johnson | 464/151 |
| 1,418,380 | 6/1922 | Keck | 464/125 X |
| 1,463,306 | 7/1923 | Bushnell | 403/114 X |
| 2,526,105 | 10/1950 | Adams | 403/57 |
| 3,406,534 | 10/1968 | Chapper . | |
| 3,638,352 | 2/1972 | Christiansen | 446/102 X |
| 3,648,404 | 3/1972 | Ogsbury et al. | 446/102 X |
| 3,713,248 | 1/1973 | Heubl | 446/102 |

FOREIGN PATENT DOCUMENTS

| | | | |
|---|---|---|---|
| 65331 | 11/1982 | European Pat. Off. | 464/152 |
| 119989 | 9/1984 | European Pat. Off. | 464/152 |
| 173012 | 3/1986 | European Pat. Off. | 464/112 |
| 0319002 | 6/1989 | European Pat. Off. . | |
| 2755883 | 12/1976 | Germany | 446/102 |
| 2732897 | 2/1978 | Germany . | |
| 3504220 | 8/1986 | Germany | 446/36 |

*Primary Examiner*—Robert A. Hafer
*Assistant Examiner*—D. Neal Muir
*Attorney, Agent, or Firm*—Kane, Dalsimer, Sullivan, Kurucz, Levy, Eisele and Richard

[57] ABSTRACT

A cardan joint is provided for transmitting rotation between first and second parts of a toy building set. A first rotating part consists of a shaft having a coupler head at one end in the form of flaps which project radially outwardly with respect to the shaft axis and which form spherical segments of a cardan ball. A second rotating part includes a cavity into which the coupling head of the first part fits. Carrier pins extend radially inwardly into the cavity to mesh between and be displaced along the flaps so that the coupler head with the flap may be tiltable about at least one pin.

8 Claims, 3 Drawing Sheets

CARDAN JOINT FOR A TOY BUILDING SET

BACKGROUND OF THE INVENTION

The present invention relates to a cardan joint for transmission of rotation between a first and a second rotating part of a toy building set comprising various building elements having different types of coupling means, e.g. ball heads or coupling studs positioned with mutual modular measures.

Cardan joints are widely used within mechanics, where they constitute one of the most important coupling types for transmission of rotation from one rotating part to another. Such cardan joints are so dimensioned as to function optimally in precisely the function for which they are used. Such power transmission may be for cars, machines etc, where the dimensioning has been made in view of the power to be transmitted, the angle between the two rotating shafts and a number of other parameters, such as cost, space and life. Precisely in view of the special demands placed on the strength of the cardan joints, cardan joints will normally never be constructed for use within several areas.

Cardan joints for use in connection with existing toy building sets must meet entirely different demands than the above mentioned kind of cardan joints, as for this use it is not a question of critical mechanical loads, but on the contrary a wish for large flexibility, i.e. the existent need is for such a cardan joint being directly suited for building into various constructions and at the same time being easy to assemble and disassemble.

SUMMARY OF THE INVENTION

U.S. Pat. No. 3,406,534 describes a universal coupling for transmitting torque from one shaft to another shaft. The universal coupling is for use in connection with toys. The first shaft of the coupling is provided with a ball head with protruding pins, while the second shaft is provided as a socket with longitudinal side slots for adaption of the pins of the ball head. In some scases it is inexpedient that the socket has longitudinal side slots, since the socket will than have to be provided with relatively thick walls in order to obtain the necessary thickness.

It is the object of the invention to devise a cardan joint for transmission of rotation between two rotating parts of a toy building set, the cardan joint being directly suited for building integral with the existing elements of the building set.

The object is achieved in that a first rotating part comprises a shaft with a coupler head in the form of radially projecting flaps in the axial direction of the shaft, the coupler head being so shaped that the contour of the flaps in a circular coupling area between the first and the second rotating part essentially follows a spherical surface, and that the second rotating part has a cavity for receiving the first rotating part, and that the second rotating part is provided with at least one pin projecting radially within and being displaceable along the flaps of the first rotating part. The second part is provided with one or more pins, carrier pins, which in operation are in mesh with the flaps of the first part and are displaceable along these flaps. The travel of the pins along the flaps depends on the angle between the two axes of rotation. The transmission of rotation between the two rotating parts is provided by contact between a carrier pin and a flap.

Advantageously, the first rotating part may comprise a cardan ball with axially progressing tracks being adapted for cooperation with one or more carrier pins projecting radially inwards the cavity formed by the second rotating part. By these axial tracks being provided evenly distributed around the cardan ball in the radial direction the cardan joint is easy to assemble and disassemble, as the cardan ball must merely be passed into the second part by an axial movement in order to pass one or more carrier pins into engagement with arbitrary longitudinally progressing tracks on the cardan ball.

The second rotating part may then be provided with locking bosses for releasably retaining the cardan ball, some of these bosses being provided on axially resilient tongues which, when the ball is in position, can be fixated by a locking ring. This locking ring can then be used as a bearing ring for the second rotating part, and may be provided with coupling means for coupling with other components of the toy building set. These coupling means may be ball heads positioned on radially outwardly projecting arms and will, when these arms stretch out in a plane transversely to the second axis of rotation, be used for controlling the direction of this axis of rotation. This will be the case when the locking ring has four opposite ball heads. If the distance between the centre of the locking ring and the centre of one of these ball heads corresponds to two modular measures, the direction of the second pivot shaft is easily controlable, e.g. by means of a Bowden-cable which may then be drawn parallelly to the shaft of the first rotating part and be secured to the supporting structure thereof.

BRIEF DESCRIPTION OF THE DRAWINGS

In the following the invention is described in more detail, reference being made to the drawing in which.

DETAILED DESCRIPTION OF THE PREFERRED EMBODIMENT

Figure 1:
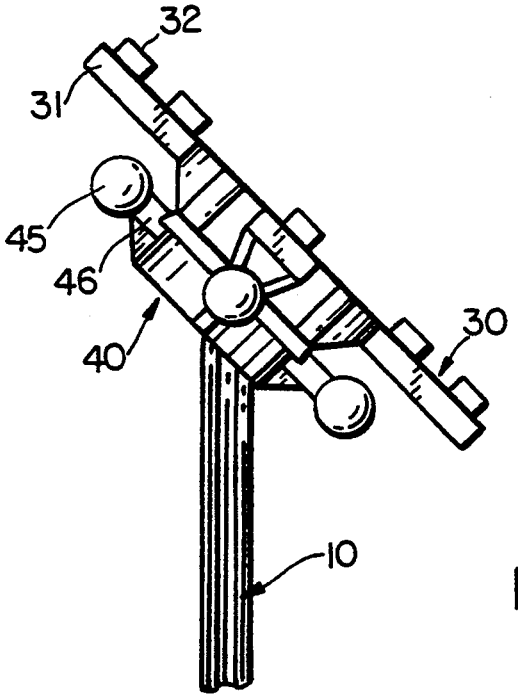
FIG. 1 shows a preferred embodiment of a cardan joint according to the invention.

A preferred embodiment of a cardan joint according to the invention where the driving part in the cardan joint is constituted by a cross-shaped shaft 10, being in engagement with a cardan ball 15 (FIGS. 2 and 3), being encircled by a cross-shaped element 30 constituting the driven part of the cardan joint. The cross-shaped element 30 has four radially projecting vanes 31 being provided with coupling pins and thus being adapted for coupling with other parts of the toy building set. The cross-shaped element 30 rests pivotably in a combined locking and guide ring 40 having a number of radially projecting arms 46 at the ends of which ball heads 45 have been mounted.

Figure 2:
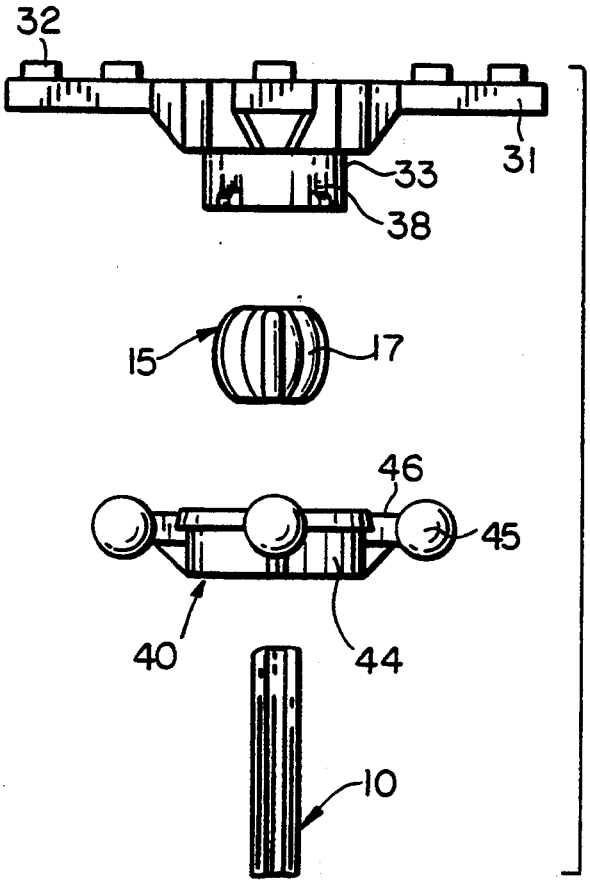
FIG. 2 shows an exploded view of the cardan joint shown in FIG. 1.
Figure 3A:
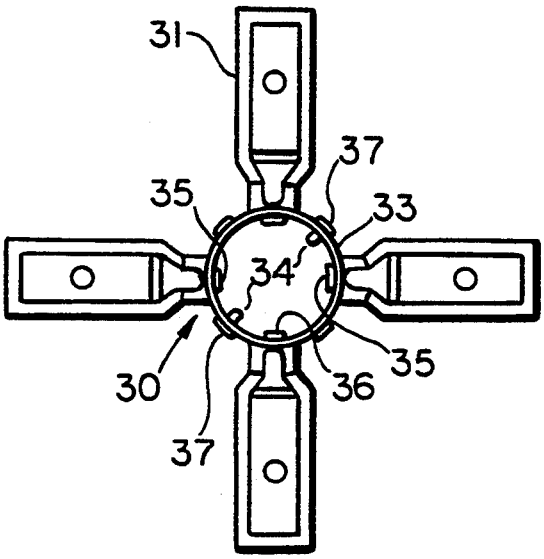
FIGS. 3*a–c* shows a view from below of the parts of the cardan joint shown in FIGS. 1 and 2.
Figure 3B:
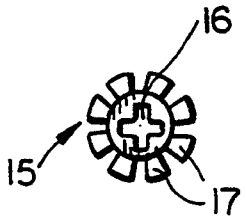
Figure 3C:
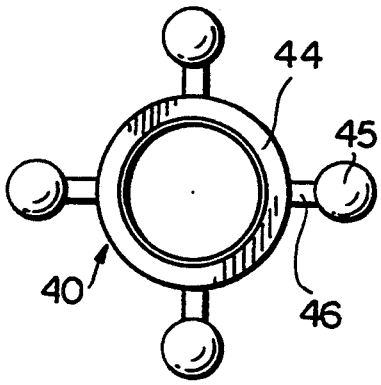

FIGS. 2 and 3 show the individual parts in disassembled state, and it can here be seen that the cardan ball 15 has a cross-shaped duct for receiving the shaft 10. In practice the cardan ball 15 is formed as a bushing being provided in its axial direction with radially projecting flaps, between which a number of ducts has been formed. The contour of the flaps is spherical. The cardan ball 15 is adapted for being received in a cylindrical cavity 33, in which the ball 15 rests pivotably between annular stop means provided in the cylinder cavity. According to the preferred embodiment the stops are shaped as ring segments and constituted by opposed stops 36 and opposed stops 35 on flexible flaps. When the cardan ball 15 is in its working position, two opposed carrier pins will pass into engagement between the flaps of the ball so that the element 30 will follow the rotation of the cardan ball 15. The cardan ball 15 may be passed by the stops 35 on the flexible flaps 38 as the latter may be bent radially outwards. When the cardan ball 15 is positioned in the cylinder 33 it can be retained in position as the flaps 38 can be ensured against deflection by positioning the guide ring 40, as a cylinder body 44 formed by the guide ring 40 prevents radial deflection of the flexible flaps 38. The position of the guide ring 40 is retained by the provision along the edge of the cylinder 33 formed by the element 30 of stops 37 for the guide ring 40. In the radial direction the guide ring has four opposed arms 46 being provided at their ends with ball heads. The guide ring 40 is so constructed as to be pivotable in relation to the axis of rotation of the element 30.

Thus by engagement with the ball heads 45 of the guide ring 40 it is possible to control the inclination of the guide ring, and consequently the inclination of the cross-shaped element 30 in relation to the shaft 10. In other words, it is possible to control the axis of rotation of the element 30 in relation to the shaft 10. The element 30 will follow the rotation of the shaft 10 as the carrier pins project radially within and are displacable along the flaps 17 of the cardan ball 15.

Figure 4:
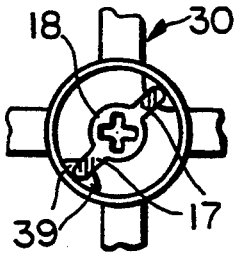
FIG. 4 shows an alternative embodiment of a cardan joint according to the invention.

FIG. 4 shows an alternative embodiment of the cardan joint, this embodiment instead of a cardan ball 15 being a bushing 18 with a cross-shaped duct for receiving a shaft 10. This bushing 18 has two opposed projecting flaps 17. The driven part 30 has similar to the preceeding example a cavity for receiving the driving part 18. The contour of the projecting flaps will also be spherical, allowing the two parts of the cardan joint to move in relation to each other with two different axis of rotation. On the inner side of the cylinder shaped driven part there are provided pairs of carrier pins on each side of the two projecting flaps 17. As in the example above, an encircling stop (not shown) is provided which prevents the bushing 18 with the two projecting flaps 17 from falling out. By suitable inter-spacing between the carrier pins 39, the two parts of the cardan joint are allowed to have its separate axis of rotation.

Figure 5:
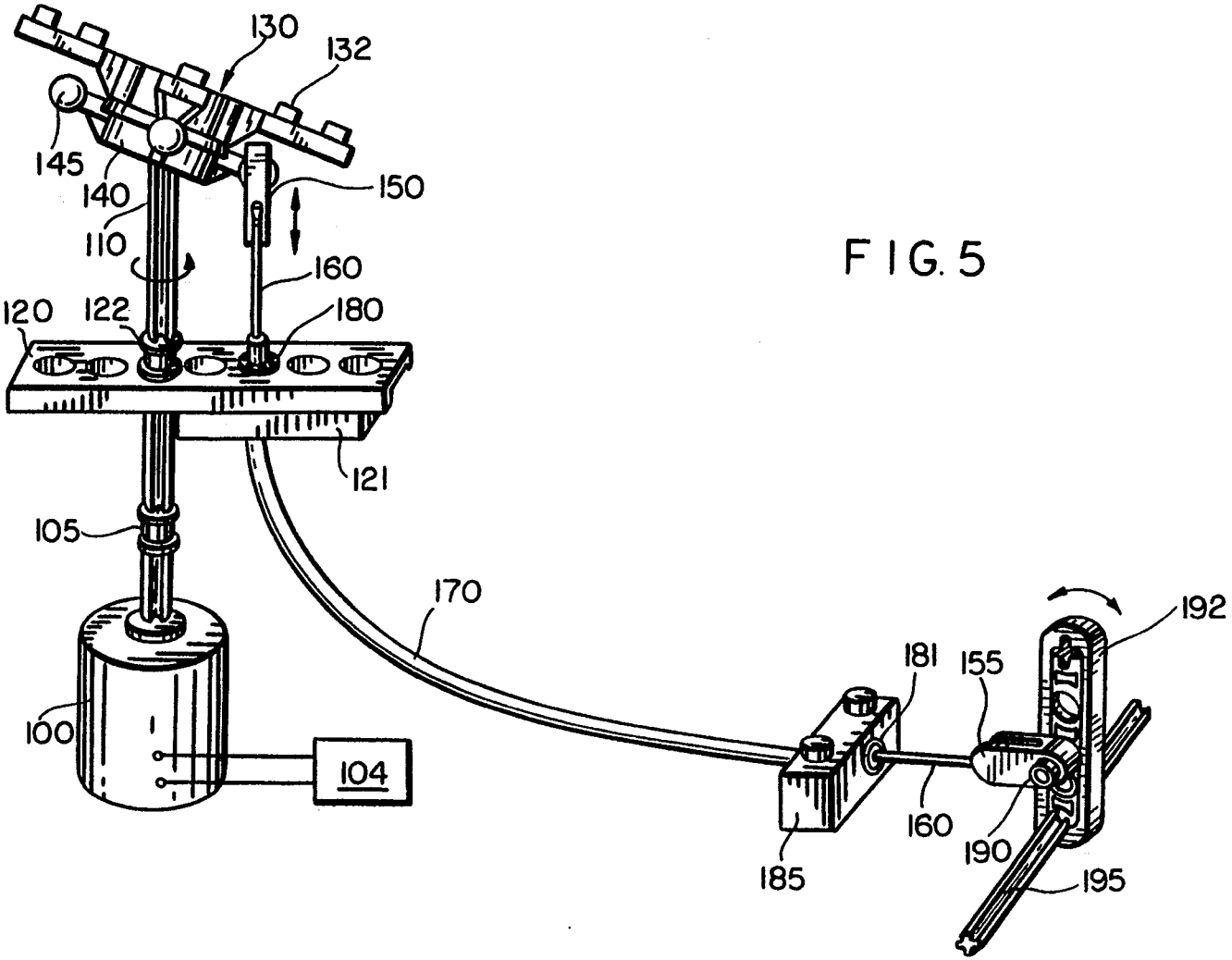
FIG. 5 shows an example of use of a cardan joint according to the invention.

FIG. 5 shows an example of use of such a cardan construction. The construction shown may e.g. be used as a helicopter rotor. A power supply and power regulator 104 controls the supply power for an electromotor 100 having a driving shaft 102 which via a connector 105 is connected to the rotor shaft of the helicopter. The shaft passes through a flat building element 120 provided with holes for receiving shafts and bushings. The shaft 110 is retained in vertical position in relation to the flat building element 120 by means of positioning rings 122 being positioned on each side of the flat building element. The shaft 110 is secured to the hidden cardan ball which is in engagement with carrier pins on the inner cylinder surface of the cross-shaped element 130, whereby the rotation of the latter is provided by the shaft 110. The cross-shaped element 130 has four radially projecting arms with coupling studs 132 by which helicopter wings may be mounted. The guide ring 140 is pivotable about the tubular part of the cross-shaped element 130 so that the guide ring 140 can be used for controlling the inclination of the element 130 relative to the horizontal. The guide ring 140 has four radially projecting arms with ball heads 145. A coupler head 150 is secured to one of these ball heads 145. This coupler head 150 is connected to a flexible cable 160 and is passed into a bushing 180 stretching throughout the flat building element 121, as well as an additional element 122, whereby the bushing is capable of retaining a flexible envelope 170, the other end of which is secured by a bushing 181 onto a building element 185. At its other end the cable 160 is secured onto a coupler head 155 which via a bushing 190 is secured onto a lever or swivel arm 192 being pivotable about a stationary pivot shaft 195. The shaft 195, the building element 185, the building elements 120 and 121 and the electromotor 100 are secured onto stationary constructional parts being left out for reasons of clarity. By pivoting the swivel arm 192 about the shaft 195, the cable 160 is displaced in the lining 170, and the rotation about the shaft 195 causes a linear displacement of the coupler head 150, thus changing the inclination of the cross-shaped element 130. By connecting yet one of the ball heads 145 of the guide ring 140 to similar guide means it is possible to control the inclination of the plane being stretched out by the cross-shaped element. Alternatively, the other ball head can be fixed relatively to the flat building element 120, whereby the element 130 can only be tilted about one shaft.

The cardan joint according to the invention may of course also be used for other purposes, e.g. in a resilient wheel suspension for a car built with the toy building set. Thus, the car can be built with individual wheel suspension and may e.g. be provided with four-wheel-drive. The shaft 10 will thus be driving shaft, whereas the driven part 30 can be connected to the wheel proper. The resilient suspension of the wheel may thus be connected to the guide ring 40.

The driven part 30 has until now been described as having four projecting vanes 31, forming a cross. This, however, is not a must, as the driven part 30 could be dished and be provided with coupling means for coupling with an additional shaft. This second shaft may then form part of a construction in which it describes a fixed angle with the first shaft. Thus, the guide ring 40 will here only act as locking ring and function as a support for the cardan joint.

We claim:

1. A cardan joint for transmission of rotation between a first and a second rotating part of a toy building set, said cardan joint first rotating part comprising a shaft (10) having a coupler head (15) having radially projecting flaps (17) extending along in axial dimension of the shaft, said second rotating part comprising surfaces defining an essentially cylindrical cavity (33) receiving the first rotating part in a snap fit connection, wherein the coupler head (15) is shaped so that the contour of the flaps is arcuate in a circular coupling area between the first and the second rotating parts, and the second rotating part is provided with at least one pin (34, 39) projecting radially inwards engaging said flaps and displaceable along the flaps (37) of the first rotating part; and said snap fit connection includes resilient stop means past which said coupler head may be forced.

2. Cardan joint according to claim 1, characterized in that the coupler head (15) of the first rotating part is shaped as a cardan ball the periphery of which being provided with axially progressing tracks thereby forming said radially projecting flaps for cooperation with said at least one pin (34) projecting radially inwards the cavity formed by the second rotating part.

3. Cardan joint according to claim 1, characterized in that the cavity (33) is cylindrical and open in the axial direction to a side where the cylindrical wall is provided with axial slits so as to form axially resilient tongues (38) having inwardly projecting locking bosses (35), thus limiting the axial movability of the ball in the cylindrical cavity, and that a locking ring (40) is provided which is adapted for encircling the said cylindrical wall so that the position in the coupled state prevents radial deflection of the said tongues (38).

4. Cardan joint according to claim 3, characterized in that the locking ring (40) is provided with coupling means (45) for coupling with other components of the toy building set.

5. Cardan joint according to claim 4, characterized in that the coupling means (45) are ball heads positioned on radially projecting arms (46).

6. Cardan joint according to claim 5, characterized in that the locking ring (40) has four opposed ball heads (45), and that the distance between the centre of the locking ring and that of a ball head corresponds to two modular measures.

7. Cardan joint according to claim 1, characterized in that the first rotating part is adapted for pivoting about a first, fixed axis of rotation and for driving the second rotating part about a second axis of rotation, where the angle between the first and the second axis of rotation can be adjusted.

8. Cardan joint according to claim 7, characterized in that the angle between the first and the second axis of rotation can be adjusted by influencing at least one of the ball heads (45) of the locking ring in a direction being essentially parallel to the first axis of rotation.

* * * * *